United States Patent [19]

Dreher

[11] Patent Number: 4,835,993

[45] Date of Patent: Jun. 6, 1989

[54] COMMERCIAL/INDUSTRIAL WASHING MACHINE

[75] Inventor: Adolph E. S. Dreher, Wichita Falls, Tex.

[73] Assignee: Washex Machinery Corporation, Wichita Falls, Tex.

[21] Appl. No.: 41,726

[22] Filed: Apr. 23, 1987

[51] Int. Cl.[4] ..... D06F 37/06

[52] U.S. Cl. ..... 68/142; 68/210

[58] Field of Search ..... 134/153, 157; 68/24, 68/210, 142; 210/380.3, 381

[56] References Cited

U.S. PATENT DOCUMENTS

| | | | |
|---|---|---|---|
| 2,296,257 | 9/1942 | Breckenridge | 68/24 |
| 2,330,605 | 9/1943 | Meyer | 68/210 X |
| 3,094,860 | 6/1963 | Ferrah | 68/210 |
| 3,117,926 | 1/1964 | Starr et al. | 210/144 |
| 3,214,946 | 11/1965 | Starr et al. | 68/24 |
| 3,364,588 | 1/1968 | Ziegler | 68/210 X |
| 3,387,310 | 6/1968 | Marshall | 68/24 X |
| 3,388,410 | 6/1968 | Marshall | 68/24 X |
| 3,529,450 | 9/1970 | Pellerin | 68/210 X |
| 3,604,221 | 9/1971 | Pellerin | 68/12 |
| 3,677,039 | 7/1972 | Files | 68/210 X |
| 3,712,090 | 1/1973 | Toth et al. | 68/210 |
| 3,742,738 | 7/1973 | Frotriede | 68/210 |
| 3,768,282 | 10/1973 | Miller et al. | 68/210 X |
| 3,803,882 | 4/1974 | Brennan | 68/210 X |

FOREIGN PATENT DOCUMENTS

| | | | |
|---|---|---|---|
| 1410063 | 7/1959 | Fed. Rep. of Germany . | |
| 2126844 | 5/1971 | Fed. Rep. of Germany . | |
| 3143140 | 11/1983 | Fed. Rep. of Germany . | |
| 937573 | 6/1982 | U.S.S.R. | 68/142 |
| 514001 | 10/1939 | United Kingdom . | |
| 655729 | 9/1951 | United Kingdom . | |

*Primary Examiner*—Frankie L. Stinson

*Attorney, Agent, or Firm*—Hubbard, Thurman, Turner & Tucker

[57] ABSTRACT

A commercial/industrial washing machine is provided with a body section which is pivotable between a loading and washing position in which the body section is horizontal, and an unloading position in which the body is forwardly inclined at an angle of approximately 7.5°. The body section carries a washing drum which is rearwardly and downwardly inclined at an angle of approximately 2.5° relative to the body section and is provided with internal breaker ribs inclined at an angle of approximately 15° relative to the drum axis. A loading chute is pivotally connected to the upper end of the body section and is movable between a raised position in which the chute is spaced apart from the drum opening, and a lowered position in which the chute outlet communicates with the interior of the drum, the chute being provided with a counterweight system to counterbalance the weight of the chute. During loading of the machine the body section is moved to its horizontal loading and washing position, the chute is moved to its lowered position, and the drum is rotated. Dry launderable items are then dropped into the chute and water is flowed through the chute into the rotating drum. The water flowing through the chute wets and compresses the launderable items therein and assists in carrying them into the drum where they are engaged by forward end portions of the rotating breaker ribs. The inclined ribs function to automatically pull the items into the drum. During rotational oscillation of the drum the inclined ribs also function to impart an axial oscillation to the items being laundered to significantly improve the washing and rinsing action of the machine, an action which is further enhanced by the slight rearward and downward tilt of the rotating drum. The drum is provided with an annular forward end wall portion which is forwardly and radially inwardly sloped at an angle of approximately 15° relative to a plane perpendicularly intersected by the drum axis and positioned rearwardly of such forward end wall portion. With the body section in its forwardly tilted unloading position this sloped drum wall portion adds an extra measure of forward tilt to the outlet portion of the drum to further facilitate the unloading of the machine.

34 Claims, 4 Drawing Sheets

COMMERCIAL/INDUSTRIAL WASHING MACHINE

BACKGROUND OF THE INVENTION

The present invention relates generally to washing machine apparatus, and more particularly provides a commercial/industrial washing machine having a variety of unique structural and operational features incorporated therein that significantly improve and simplify the loading and unloading of the machine, and additionally enhances the washing and rinsing effectiveness thereof.

Commercial/industrial washing machines are very large and very heavy units used to launder linen in, for example, hotels, industrial laundries and large hospitals. "Linen" is a generic laundry industry term encompassing a wide variety of launderable items—such as sheets, pillow cases, table cloths, towels, uniforms and the like—whether such items are of an actual linen material or of another material such as cotton or polyester. The great size, weight and bulk of the typical commercial-/industrial washing machine has heretofore rendered its linen loading and unloading process a difficult, time-consuming, awkward and potentially dangerous task.

Conventional washing machines of this type include a main body section which is supported on a floor-mounted structural frame and is hydraulically pivotable relative to such frame between a loading position in which the body is rearwardly tilted at an angle of approximately 15°, a wash position in which the body is horizontally disposed, and an unloading position in which the body is forwardly tilted at an angle of approximately 12°. Since the weight of the body section of even a medium-sized commercial/industrial washing machine often is in excess of 10,000 pounds, it can be seen at the outset that the tilting of the body through its approximately 27° angular range requires a hydraulic system of considerable power and ruggedness.

Carried within the machine's body is a large cylindrical washing drum which is rotationally drivable about its longitudinal axis by a suitable drive system also housed within the body. The drum is positioned within the body in a manner such that when the body is in it horizontal washing position the drum axis is also horizontal. An access door is pivotally mounted on the front end of the machine's body to selectively cover and uncover the front end opening of the drum. To agitate the linen disposed within the drum during the wash and rinse portions of the machine's wash cycle, the interior of the drum of provided with a circumferentially spaced series of axially extending breaker ribs.

The following description of one complete load-wash-unload cycle of a conventional commercial/industrial washing machine is illustrative of the complex, time-consuming and somewhat awkward nature of its use. To begin the cycle, the drum is filled with a low level of water, the machine door is opened, and the body is slowly pivoted to its rearwardly inclined loading position in which the drum axis is rearwardly and downwardly inclined at an angle of approximately 15°. This rearward tilting of the machine body moves the front end opening of the drum (which is at a fairly high elevation) rearwardly while at the same time moving the lower front corner of the machine body forwardly, thus rendering manual access to the drum opening somewhat awkward.

Next, a first load of linen is brought to the machine—a task which is typically performed by utilizing an overhead laundry bag sling system, a suitable conveyor system, or other appropriate loading apparatus. The first batch of dry linen is hand loaded into the drum opening and is pushed rearwardly into the drum toward the back end thereof. A second batch of dry linen is then also brought to the machine and is hand-stuffed into the drum. This hand stuffing of the second linen batch into the drum is even more difficult and awkward since the first batch of dry linen occupies a considerable portion of the drum interior. When this second linen batch is stuffed into the drum, the machine door is closed and the body section is forwardly tilted through an angle of approximately 9° and the machine door is closed. The drum is then rotated to thoroughly soak, and thereby considerably reduce the volume of, the first and second batches of linen.

After this soaking and volume reduction phase is completed, the rotation of the drum is terminated, the machine body is again rearwardly tilted to its loading position, and the machine door is opened. A third and final batch of linen is brought to the machine and hand-stuffed into the drum. The machine body is then forwardly pivoted through an angle of approximately 9° and the machine door is closed. The machine body is then forwardly pivoted to its horizontal washing position and an appropriate wash cycle is selected to automatically wash, rinse, and extract residual rinse water from the linen.

After the wash cycle has been completed, the machine door is opened, and the machine body is forwardly tilted to its unloading position. A laundry cart is wheeled up to the machine, and the drum is sequentially rotated in opposite directions. This opposite rotation of the drum tends to automatically force the washed linen outwardly through the drum opening while one or more workers pull on the linen and cause it to fall into the receiving cart. When the washed linen has been fully unloaded, the machine body is slowly tilted rearwardly, through an angle of approximately 27°, to its loading position so that another load-wash-unload cycle can be initiated.

It has been known for some time that the rather time-consuming, difficult and somewhat awkward task of manually stuffing the various linen batches into the drum can be significantly facilitated by rotating the drum during this manual stuffing process. However, this creates the potential for serious worker injury in the event that a worker's hand or arm is ensnared by the rotating linen and/or one of the internal drum ribs. Accordingly, the practice of rotating the drum during the loading process is usually not employed.

It can be clearly be seen from the foregoing that conventional commercial/industrial washing machines are subject to a variety of problems, limitations and disadvantages. It is accordingly an object of the present invention to provide improved commercial/industrial washing machine apparatus which eliminates or minimizes above-mentioned and other problems, limitations and disadvantages associated with such conventional apparatus.

SUMMARY OF THE INVENTION

In carrying out principles of the present invention, in accordance with a preferred embodiment thereof, an improved commercial/industrial washing machine is provided in which the loading and unloading thereof is significantly improved and simplified, and the washing and rinsing effectiveness of the machine is considerably enhanced.

The improved washing machine of the present invention includes a body section which is pivotable between a loading and washing position in which the body is generally horizontally disposed, and an unloading position in which the body is forwardly tilted at a relatively small angle which is preferably in the range of from about 7.5° to about 12°. In the preferred embodiment of the present invention this forward tilt angle is approximately 7.5°.

Because in the preferred embodiment thereof the total body tilt range of the improved machine is only approximately 7.5° (less than one third of the corresponding 27° tilt range of conventional machines) its body may be driven between its two operating positions (i.e., its horizontal washing/loading position and its forwardly tilted unloading position) by ordinary pneumatic actuating cylinders—a considerably simpler, less expensive and more maintenance-free pivotal drive system than the hydraulic drive systems typically required in conventional commercial/industrial washing machines.

A hollow cylindrical washing drum is carried within the body for movement therewith and is rotationally drivable, by a conventional drive system housed within the machine body, about its longitudinal axis. With the body in its horizontal loading and washing position, the drum axis is downwardly and rearwardly tilted at a relatively small angle (preferably about 2.5°) relative to the body.

The drum has a front end opening adapted to receive and discharge launderable items, a rear end wall, and a longitudinally extending cylindrical side wall portion. An access door is pivotally connected to the front end of the machine body and is operative in a conventional manner to selectively cover and uncover the front end opening of the drum.

Several unique structural features are incorporated into the drum and serve, in a manner subsequently described, to significantly improve the loading, unloading, washing and rinsing processes of the machine. One of these features comprises the provision within the drum of a circumferentially spaced series of elongated breaker ribs which project radially into the drum interior from the drum side wall portion and extend longitudinally at an angle (preferably on the order of approximately 15°) relative to the drum axis. In addition to this axial slant of the breaker ribs, the radially inner side edge surfaces of the ribs are rearwardly and radially outwardly sloped along their front-to-rear lengths (at an angle preferably on the order of about 5°). According to another feature of the unique drum configuration, the drum is provided with an annular front end wall portion which circumscribes the drum's front end opening and is forwardly and radially sloped at an angle (preferably about 15°) relative to a plane perpendicularly intersected by the drum axis and disposed rearwardly of the front end wall portion.

To significantly facilitate and simplify the loading of launderable items into the drum, a loading chute is pivotally mounted on the upper end of the machine body, and actuating means are provided for pivoting the chute between a raised position in which the chute is spaced upwardly and forwardly of the drum opening, and a lowered position in which (with the machine door opened) a circular, open outlet end portion of the chute communicates with the interior of the drum. The outlet end portion of the chute is provided with an annular gasket which is adapted to engage and form a seal with an annular forward lip portion of a shell member which envelops the drum. A counterweight system is operatively associated with the chute to counterbalance the weight of the chute to thereby reduce the pivotal force required to move it between its raised and lowered positions. The counterweight system also functions as a safety device to assist in holding the chute in its raised position to prevent it from falling to its lowered position should, for example, the chute actuating means fail or misfunction.

The loading chute has a generally rectangularly shaped open inlet end portion which faces upwardly when the chute is in its lowered position. Bordering this inlet end portion of the chute is a water supply pipe header which has an inlet opening for receiving water from a source thereof, and a series of outlet openings for spraying the received water into the interior of the chute.

To load the improved washing machine of the present invention, the machine body is pivoted to its horizontal loading and washing position (in which the drum is rearwardly and downwardly tilted), the machine door is opened, the drum is rotationally driven about its axis, and the loading chute is pivoted to its lowered position. An overhead sling system is then used to position a laundry bag filled with a first batch of dry launderable items over the upwardly facing inlet end of the chute. The bottom drawstring on the laundry bag is then pulled to dump its contents into the chute. Finally, water is flowed from the pipe header downwardly through the chute into the rotating drum.

The flow of water through the chute wets and compresses the dry launderable items therein, and carries the wetted and compressed items inwardly through the drum opening at which time the items are engaged by forward end portions of the rotating breaker ribs.

Importantly, due to the unique axial inclination of the rotating ribs, once the ribs contact the launderable items they function to rather rapidly pull the items from the chute and move them generally axially toward the rear end of the drum. This unique "pulling" action of the axially inclined breaker ribs is gravity-assisted by the rearward and downward slope of the drum. The strength of this item-pulling "screw" action of the ribs diminishes in a rearward direction along their lengths due to the previously described radial slope built into the ribs. When all of the launderable items in the first batch thereof have been automatically pulled into the drum they are disposed adjacent the rear end thereof, and subsequent batches of dry launderable items can be successively dropped into the chute until the drum is adequately filled.

When the drum is filled, the chute i pivoted to its raised position, the machine door is closed and an appropriate wash cycle is initiated. In a conventional manner, during the wash and rinse portions of the wash cycle the drum is caused to rotationally oscillate in opposite directions to impart to the water and launderable items within the drum a "sloshing" action.

It is at this point in the overall load-wash-unload cycle of the improved machine that the uniquely configured drum provides yet another distinct operational advantage. Specifically, during rotational oscillation of the drum the axially inclined breaker ribs, which initially functioned to automatically pull the launderable items into the drum, cause the launderable items to axially oscillate within the drum. This axial oscillation creates an improved washing and rinsing action between adjacent items and enhances both the washing and rinsing effectiveness f the machine.

The improved washing and rinsing action imparted to the launderable items by the axially inclined breaker ribs is further enhanced by the slight rearward and downward slope of the drum maintained during the washing and rinsing process. As the rotating drum sequentially raises and then drops each item the dropped item tends to fall to a position within the drum slightly rearwardly of the position from which it was initially raised, due to the slight rearward inclination of the drum. This unique operational feature of the drum augments the axial movement of the items created by the specially designed breaker ribs.

After the wash cycle has been completed, the machine door is opened, the machine body is forwardly tilted to its unloading position, and, in a conventional manner, the drum is once more caused to rotationally oscillate to thereby discharge the laundered items into a waiting laundry cart. During this unloading process the specially designed drum once again functions to improve the overall operation of the machine. Specifically, the forwardly sloped front end wall portion of the drum effectively adds approximately 15° of forward inclination to the already forwardly sloped outlet end portion of the drum to further facilitate the laundry unloading process.

It is important to note that, with the exception of initially positioning the laundry bags and pulling their drawstrings, the entire loading and unloading operation for the improved washing machine of the present invention may be carried out without worker hand contact with the laundered items. This, of course, renders the overall laundering process considerably safer, more efficient and quicker than the loading and unloading operations in conventional machines. As previously described, these advantages arise from the unique operation of and cooperation between the specially designed chute and drum portions of the machine.

It should be further noted that, in addition to facilitating the laundry loading operation, the loading chute in its lowered position also functions as a safety guard which effectively blocks either intentional or inadvertent manual access to the interior of the rotating drum.

DETAILED DESCRIPTION

Figure 1:
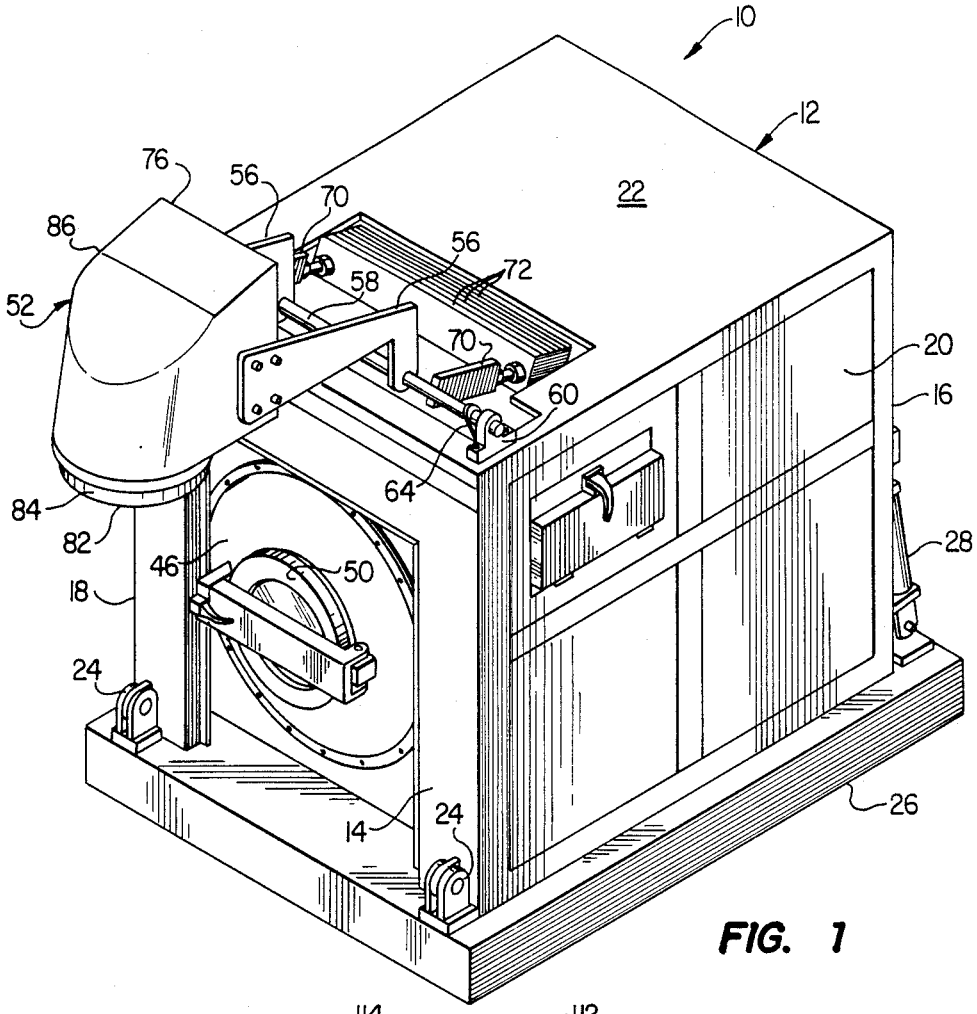
FIG. 1 is a perspective view of an improved commercial/industrial washing machine which embodies principles of the present invention.
Figure 2:
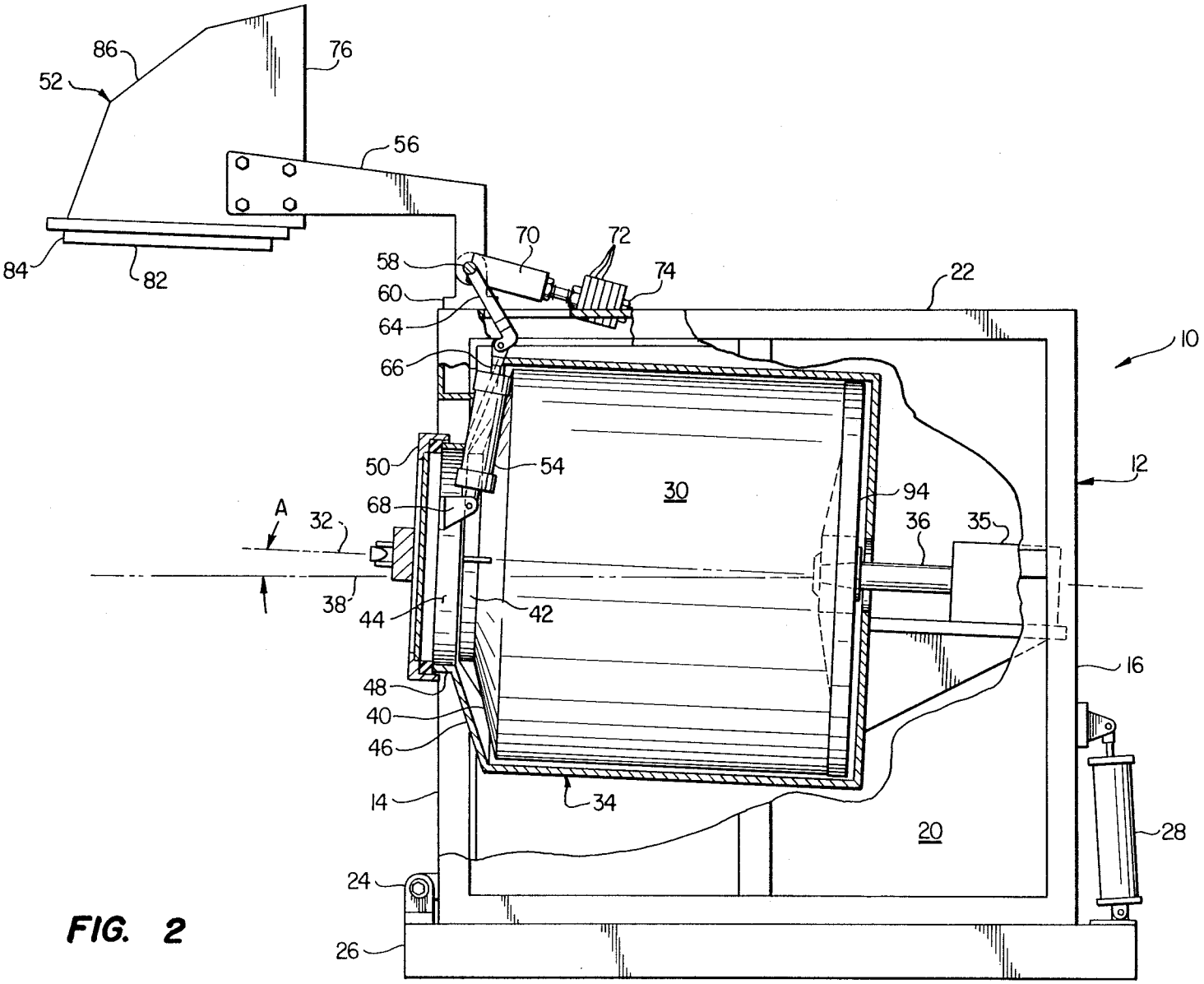
FIG. 2 is a simplified, partially cut-away right side elevational view of the washing machine, in its generally horizontal loading and washing position, with a loading chute portion thereof in an elevated position, and its internal drum shell and washing drum being respectively illustrated in section and in elevation.
Figure 6:
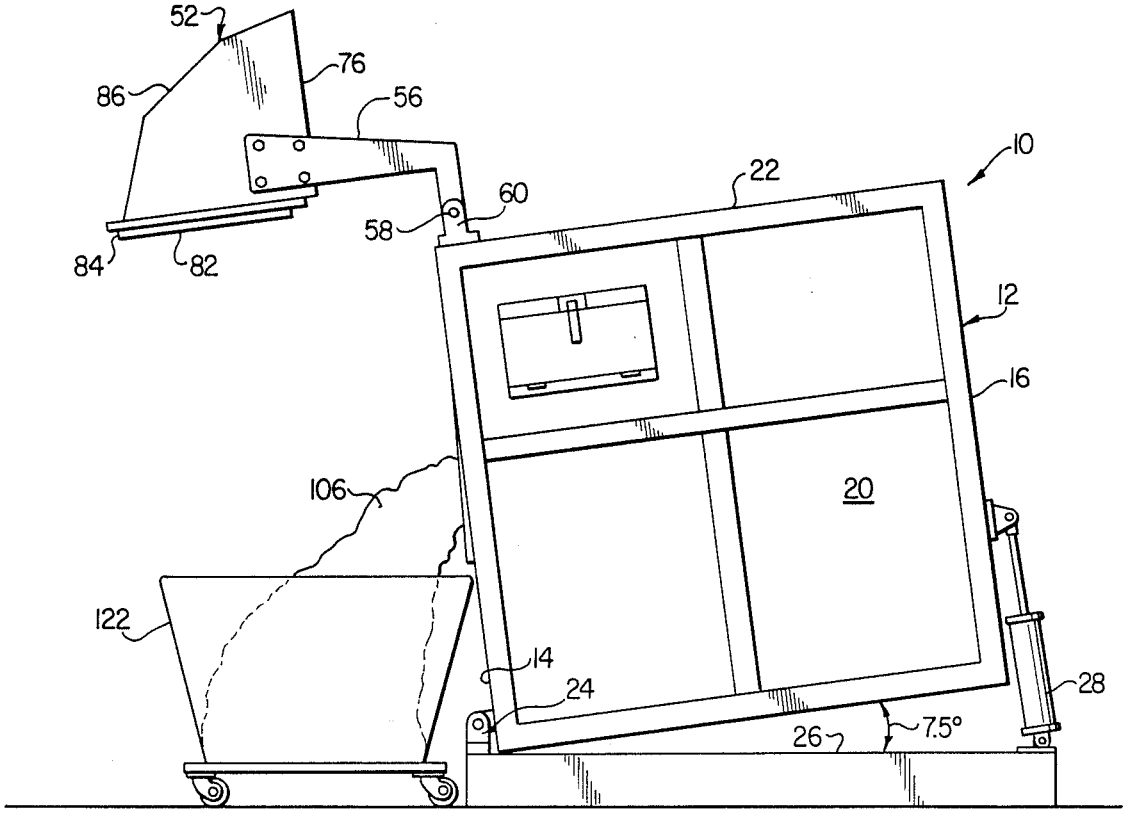
FIG. 6 is a simplified right side elevational view of the washing machine in its forwardly tilted unloading position during the laundry unloading process, the machine's door being deleted for illustrative clarity and only a portion of the chute mounting structure being illustrated.

Illustrated in FIGS. 1 and 2 is a commercial/industrial washing machine 10 which embodies principles of the present invention and is utilized to launder a variety of items (generically referred to in the laundry industry as "linen") such as sheets, pillow cases, table cloths, uniforms and towels. The machine 10 includes a generally rectangularly shaped base or body portion 12 which has a front wall 14, a rear wall 16, a left side wall 18, the right side wall 20, and a top wall 22. Body 12 is pivotally connected at lower left and right front corner portions thereof to pivot members 24 that are secured to a rectangular base frame 26 that rests upon the floor of the laundry facility. By means of a series of pneumatic actuating cylinders 28 (only one of which is illustrated) operatively interconnected between the body 12 and its support frame 26, body 12 is selectively pivotable between a loading and washing position in which the body 12 is in the horizontal position depicted in FIGS. 1 and 2, and an unloading position in which the body 12 is forwardly pivoted approximately 7.5° about the pivot members 24 as depicted in FIG. 6.

It should be noted at the outset that the total amount of pivotal motion of the improved washing machine 10, in the illustrated preferred embodiment thereof, is advantageously limited to a total of approximately 7.5°. This is a very significant reduction in the total amount of pivotal motion typically required in conventional machines of this type which must be provided with a total pivotal motion range on the order of approximately 27°. Because of this reduction, the body 12 may be more quickly moved through its entire pivot range, and a pneumatic pivot drive system may be utilized instead of the more expensive hydraulic drive system required in conventional machines. While a forward tilt angle of approximately 7.5° is preferred, a somewhat larger forward tilt angle (up to about 12°) could be employed if desired.

Carried within the body 12 are a washing drum or cylinder 30 having a central longitudinal axis 32, and a drum shell 34 which outwardly and coaxially circumscribes the drum 30 and has the same general external configuration. In a conventional manner, the drum is rotationally driven during the various portions of the machine's wash cycles by motor means 35 disposed within the body 12 and operatively interconnected with the drum 30 by a drive shaft 36.

The drum 30 and its shell 34 are supported within the body 12 so that with the body 12 in its horizontal loading and washing position, the drum axis 32 is rearwardly and downwardly inclined relative to the horizontal reference line 38 at a relatively small angle A, the drum and shell inclination angle being approximately 2.5° in the illustrated preferred embodiment of the washing machine 10. Accordingly, when the body 12 is in it loading and washing position, the axis 32 is rearwardly and downwardly tilted, and when the body 12 is forwardly pivoted to its unloading position, the axis 32 is forwardly and downwardly inclined relative to the horizontal reference line 38 at an angle of approximately 5°.

For purposes subsequently described, an annular left or forward end portion 40 of the drum 30 (FIGS. 2 and 5) is uniquely provided with a forward and radially inward slope of approximately 15° relative to a plane perpendicularly intersected by the drum axis 32 and positioned rearwardly of the end wall portion 40. The sloped drum portion 40 terminates at its forward end in an annular drum ring 42 which defines a forward end opening 44 in the drum. A forward end portion 46 of the outer shell 34 is given a similar 15° slope and terminates in an annular shell lip 48 which extends slightly leftwardly of the drum lip 42. A conventional access door 50 is pivotally connected to the front body wall 14 and has provided thereon an annular seal element (not illustrated) which, with the door in its closed position, engages and is compressed by the shell lip 48 to close the open ends of the shell and drum.

Figure 3:
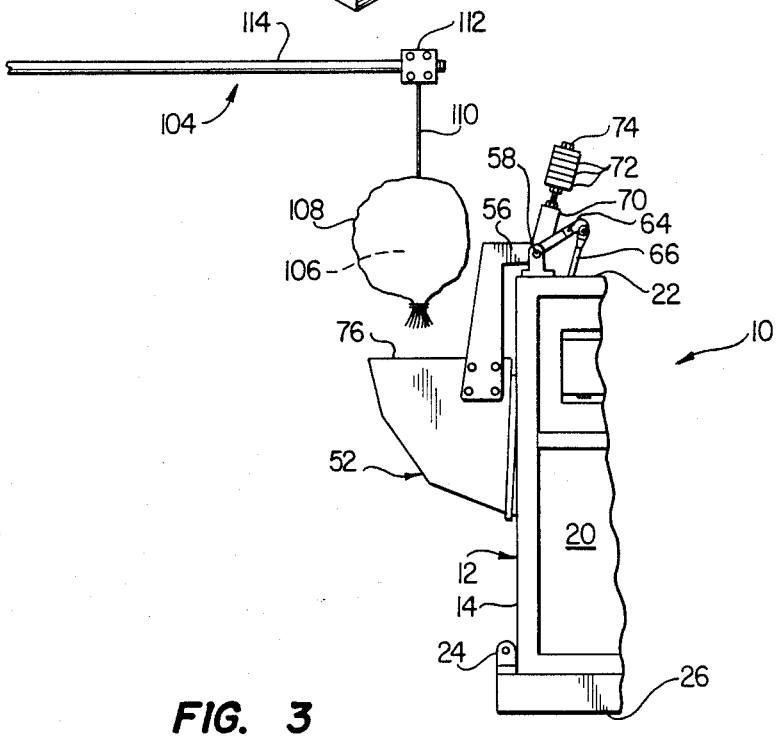
FIG. 3 is a partial right side elevational view of the washing machine with its loading chute in a lowered position and the machine's door deleted for illustrative clarity, and further illustrates an elevated sling system used to transfer laundry items to the loading chute.

The washing machine 10 is provided with a unique laundry loading and unloading system which includes a specially designed chute 52 that is pivotally connected to the upper housing end wall 22 and is pivotally drivable between a raised position illustrated in FIGS. 1 and 2, and a lowered position illustrated in FIG. 3, by means of a pneumatic actuating cylinder 54 (FIG. 2) housed within an upper right corner portion of the body 12. The outer ends of a pair of generally L-shaped support arms 56 are secured to opposite sides of the chute 52, while the inner ends of the arms 56 are fixedly secured to a pivot rod member 58 whose outer ends are appropriately journaled in a pair of pivot support members 60 that are respectively secured to the upper body end wall 22 adjacent the left and right upper front corners of the body 12.

Adjacent the right pivot support member 60 the inner end of a cylinder extension arm 64 is fixedly secured to the pivot rod 58, while the outer end of the extension arm 64 is pivotally connected to the outer end of the actuating rod 66 of the pneumatic cylinder 54. The lower end of the cylinder 54 is pivotally connected to a pivot ear weldment 68 suitably secured to the body 12.

When the cylinder actuating rod 66 is moved to its extended position, the cylinder extension arm 64 is pivoted in a counterclockwise direction, thereby pivoting the pivot rod 58 and the support arms 56 to pivotally drive the chute 52 from its raised position depicted in FIGS. 1 and 2 to its lowered position depicted in FIG. 3. In a similar fashion, when the cylinder actuating rod 66 is moved to its retracted position, the cylinder extension arm 64, the pivot rod 58, and the support arms 56 are pivoted in a clockwise direction to thereby pivot the chute 52 upwardly to its raised position.

The chute structure just described is provided with a counterweight system which functions to offset the weight of the chute to thereby reduce the pivot force required to move it between its raised and lowered positions. This counterweight system includes a pair of weight support members 70 which are fixed-at their inner ends in a spaced relationship to the pivot rod 58 and extend generally transversely thereto. Outer end portions of the support members 70 are extended through appropriate openings formed through opposite end portions of a series of generally rectangularly shaped counterweight members 72. Suitable retaining nuts 74 are threaded onto the outer ends of the support members 70 to hold the counterweights 72 thereon. The weight support members 70 are angularly oriented relative to the pivot rod 58 so that with the chute 52 in its raised and lowered positions (FIGS. 2 and 3) the support members 72 are rearwardly inclined. By placing an appropriate number of weight members 72 on the support members 70, the counterweight system can be weighted to create a net clockwise torque on the pivot rod 58 (as viewed in FIG. 2) when the chute 52 is in its raised position. This net torque serves as an important safety feature to maintain the chute in its raised position, and keep it from falling to its lowered position, if, for example, the cylinder 54 failed or its linkage became broken or disconnected.

Figure 7:
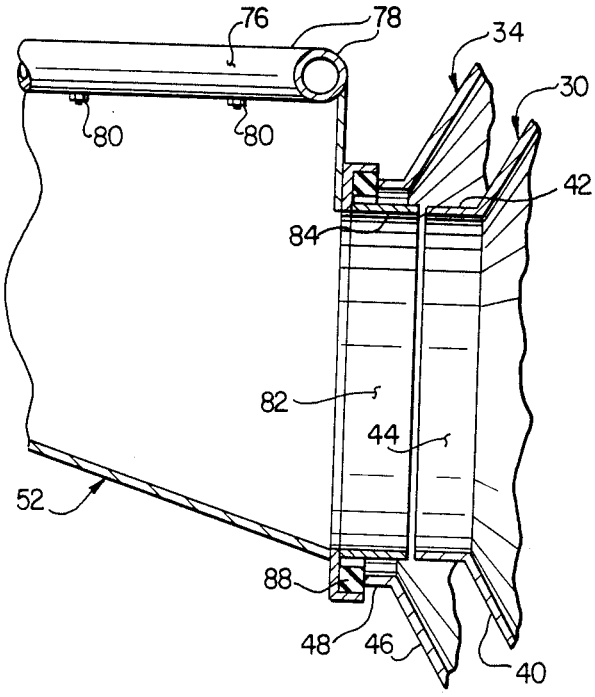
FIG. 7 is a partial cross-sectional view through the chute and adjacent machine structure, and illustrates the interengagement between the chute's annular front sealing gasket and an annular front lip portion of the drum shell.

Referring now to FIGS. 1 and 7, the chute 52 has a generally rectangular open upper or inlet end 76 which is bordered around its periphery by a water pipe header 78 having a series of small water spray outlet openings 80 (FIG. 7) formed through its bottom surface, a circular outlet end opening 82 bounded by a chute outlet ring 84, and an appropriate rectangular-to-round transition portion 86 interconnecting the inlet end 76 and the outlet end 82 of the chute. The chute outlet ring 84 is outwardly circumscribed an annular chute gasket 88. As best illustrated in FIG. 7, with the washing machine door 50 opened, and the chute 52 in its lowered or "loading" position, the chute ring 84 is coaxially received within the shell lip 48 and the chute gasket 88 is engaged and compressed by the shell lip 48 to form a waterproof seal around the periphery of the shell lip.

Figure 5:
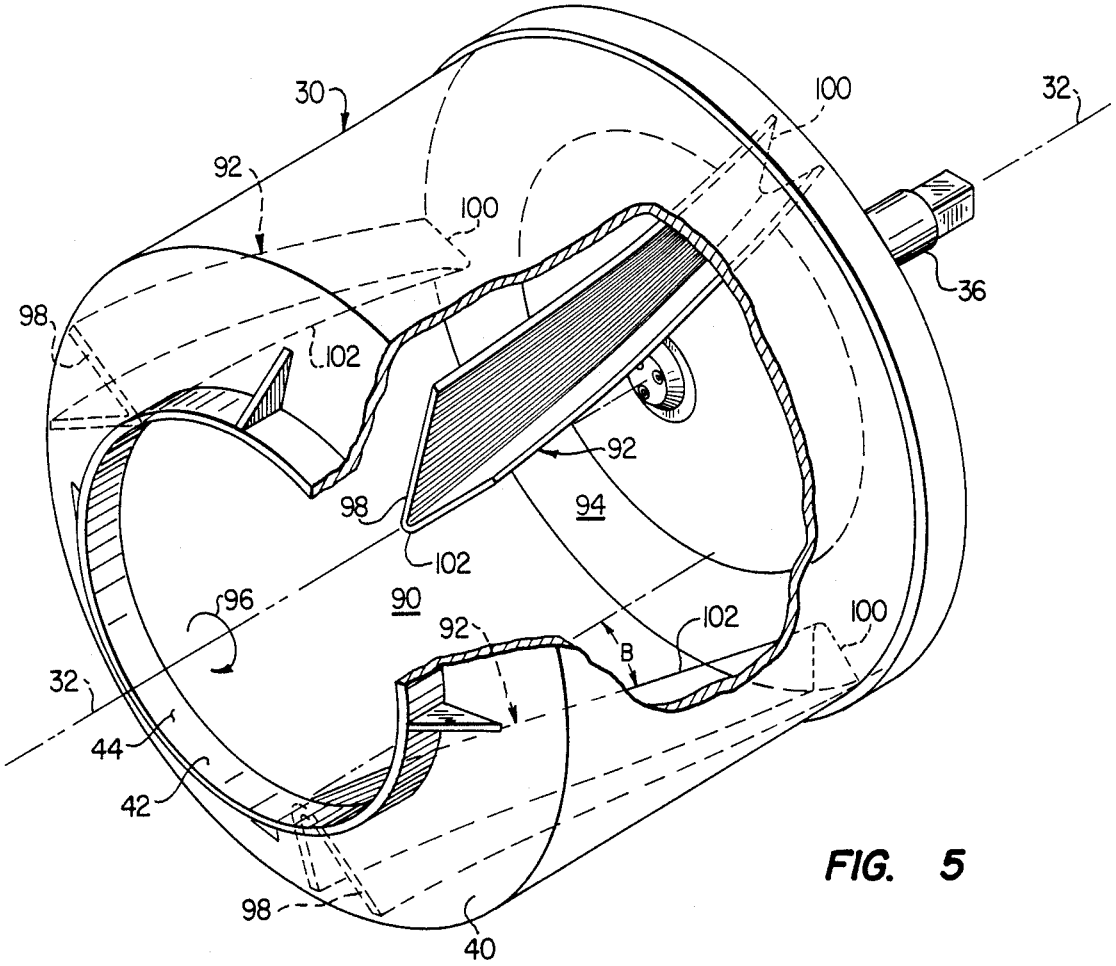
FIG. 5 is a partially cut-away isometric view of the washing drum illustrating its uniquely inclined internal breaker ribs and axially sloped forward end wall portion.

Referring now to FIG. 5, in addition to the uniquely sloped forward end wall portion 40 of the drum 30, the drum is also provided around parts axially extending interior side wall surface 90 with three circumferentially spaced, elongated breaker ribs 92 which extend longitudinally generally between the rear end wall 94 of the drum and the forwardly sloped front end portion 40, and are axially sloped relative to the drum axis 32 at an angle B which, in the illustrated preferred embodiment of the drum 30, is approximately 15°. As will subsequently be described, during the loading of laundry items into the drum opening 44, the drum is being rotated in a clockwise direction, as indicated by the arrow 96 in FIG. 5.

When the drum is to be rotated in such clockwise direction, the forward end 98 of each of the breaker ribs 92 is offset from the rear end 100 thereof in a clockwise direction around the interior drum side wall surface 90. If the drum 30 were to be rotated instead in a counterclockwise direction during loading of the drum, the axial inclination of the breaker ribs would be reversed so that their front ends 98 would be offset in a counterclockwise direction relative to their rear ends. In addition to this inclination of the breaker ribs 92 relative to the drum axis 32, their radially inner side surfaces 102 are additionally sloped in a rearward and radially outward fashion, at an angle of approximately 5°, so that the front ends 98 of the ribs project further into the drum interior then do the rear ends of such ribs.

As will be subsequently described, these uniquely oriented breaker ribs function to significantly facilitate the laundry loading process by engaging laundry items being loaded into the drum via its front end opening 44 and automatically drawing the items rearwardly into the drum during loading rotation thereof in a clockwise direction. This unique automatic loading action of the inclined breaker ribs 92 cooperates with the chute 52 to render the laundry loading process significantly easier, quicker and safer in a manner which will now be described in detail.

Referring to FIGS. 2 and 3, to load the washing machine 10, its body 12 is pivoted to its horizontally disposed loading and washing position (FIG. 2) so that the drum 30 and its enveloping shell 34 are rearwardly and downwardly tilted at an angle of approximately 2.5°. The machine door 50 is then opened and the chute actuating cylinder 54 is operated to pivot the chute 52 downwardly in a counterclockwise direction to its lowered or "loading" position as depicted in FIG. 3.

An overhead sling system 104 is utilized to transfer launderable items 106 to the chute 52 for initial loading therein through the now upwardly facing open chute inlet end 76. The launderable items 106 are contained within a suitable bag 108 which is supported by a rope or cable 110 from a roller block member 112 that is rollable along an overhead I-beam or channel member 114. The bag 108 is positioned somewhat higher than the open inlet end 76 of the chute 52 and is provided at its lower end with a drawstring 116 which, with the bag 108 disposed directly over the inlet 76 of the chute 52, may be pulled to open the bag and dump its contents into the chute. With the bag 108 positioned over the chute 52, the motor means 35 are energized to rotate the drum 30 in the previously described clockwise direction, and the drawstring 116 is pulled to drop the launderable items 106 into the chute.

Figure 4A:
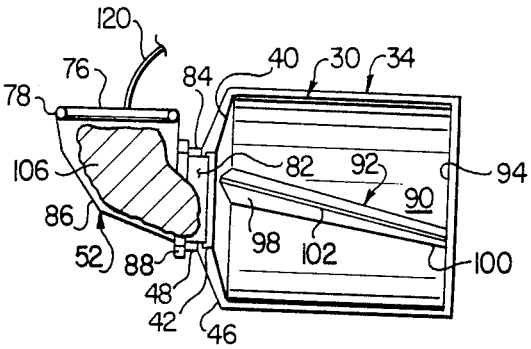
FIGS. 4A, 4B and 4C are simplified schematic cross-sectional views through the chute in its lowered position, the drum and its shell, and sequentially illustrate an improved laundry loading process of the present invention.
Figure 4B:
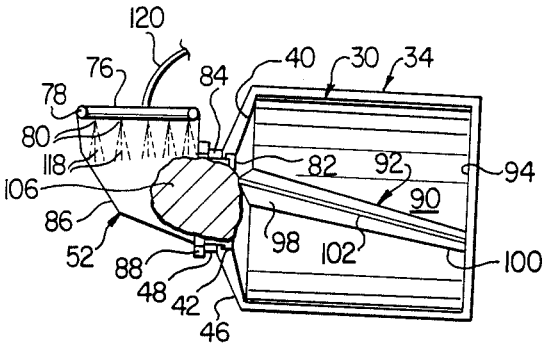
Figure 4C:
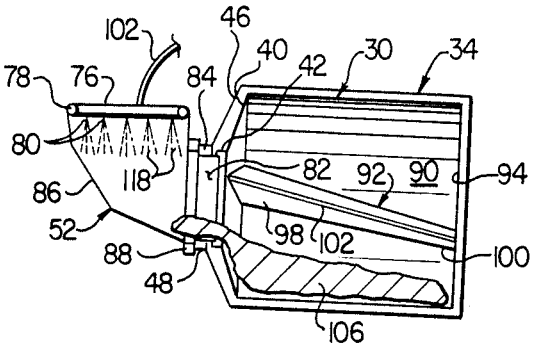

Referring now to FIGS. 4A, 4B and 4C, after the dry launderable items 106 have been dropped into the chute 52, water 118 is flowed into the pipe header 78 through a suitable water hose 120 connected to an inlet opening formed therein, and outwardly through the water spray outlet openings 80 in the header. The resulting streams of water 118 are flowed downwardly through the chute 52 (FIG. 4B) and through the launderable items, into the rotating drum 30.

Passage of this water through the launderable items 106 wets and compresses the items and causes the items to slide downwardly through the chute into its outlet end portion which is downwardly inclined toward the rear end wall 94 of the drum 30. As the wetted and compressed items are moved into the open front end of the drum 30, they are brought into contact with the rotating front ends 98 of the inclined breaker ribs 92. When this initial contact occurs, the ribs uniquely function to rather rapidly pull the wetted launderable items rearwardly into the drum toward the rear end wall 94 thereof as schematically depicted in FIG. 4C. The inclined ribs thus function to "screw" the launderable items rearwardly into the drum and position them adjacent the rear wall thereof. This unique automatic loading function of the inclined ribs is gravity-assisted by the small downward and rearward slope of the drum itself.

As the wetted and compressed launderable items are being drawn into the drum by the unique action of the inclined breaker ribs therein, the generally axially directed pulling force exerted on the items is progressively lessened as they are moved further rearwardly in the drum due to the radial slope given to the breaker ribs. Stated otherwise, since the radial thickness of each rib decreases in a rearward direction therealong, as the launderable items approach the rear end wall of the drum, the axial force thereon is diminished as they approach their final rearwardly disposed position.

In a manner similar to that just described for the first batch of dry launderable items, subsequent batches of dry launderable items may be dropped into the chute, wetted, and "flowed" into contact with the forward ends of the rotating inclined breaker ribs. The screw action of the ribs rapidly draws each successive batch of wetted laundry items rearwardly against the previously deposited batch.

It is important to note that the chute 52 not only uniquely cooperates with the inclined breaker ribs during the laundry loading process, but it also functions as an important safety device as well. Specifically, the chute, during the loading operation, automatically covers and effectively blocks the open end of the rotating drum. This makes it extremely difficult, if not impossible, for a laundry worker to reach into the rotating drum and possibly be injured by the rotating breaker ribs therein. The cooperation between the water-operated chute 52 and the inclined breaker ribs 92, moreover, renders it unnecessary for a laundry worker to even touch the launderable items once they have been deposited within the chute 52.

With the loading process completed, the chute actuating cylinder 54 is operated to pivot the chute upwardly in a clockwise direction to its raised position (FIG. 2). The washing machine door 50 is then closed. As is conventional, during the wash and rinse portions of the machine's wash cycle, the motor means 35 are operated in a manner causing the drum 30 to rotationally oscillate to thereby impart a "shloshing" action to the drum water and the launderable items therein.

During such rotational oscillating motion of the drum, the inclined breaker ribs therein provide the washing machine 10 with yet another unique advantage over washing machines of conventional construction. Specifically, during the clockwise portion of the rotational oscillation, the launderable items within the drum are forced rearwardly therein by the inclined breaker ribs as previously described for the initial loading process. However, during the counterclockwise portion of the rotational drum oscillation, the launderable items are forced forwardly within the drum. Thus, during rotational oscillation of the drum, the launderable items therein are caused to axially oscillate in a forward-to-rear fashion. This axial oscillation significantly enhances both the washing and rinsing action within the drum to markedly improve the washing and rinsing efficiency of the machine. This unique axial oscillation of the launderable items within the drum is simply not achieved in conventional drums in which the internal breaker ribs are parallel to the longitudinal drum axis.

The improved washing and rinsing action imparted to the launderable items by the axially inclined breaker ribs is further enhanced by the slight rearward and downward slope of the drum maintained during the washing and rinsing process. As the rotating drum sequentially raises and then drops each item the dropped item tends to fall to a position within the drum slightly rearwardly of the position from which it was initially raised, due to the slight rearward inclination of the drum. This unique operational feature of the drum augments the axial movement of the items created by the specially designed breaker ribs.

When the washing, rinsing, and extraction portions of the machine's wash cycle have been completed, the motion of the drum is stopped, the machine door is opened, and the machine body 12 is pivoted forwardly to its unloading position in which the body is forwardly inclined at an angle of approximately 7.5° relative to its base 26. A suitable laundry cart 122 (FIG. 6) is wheeled up to the front end of the forwardly inclined machine body 12 and the drum 30 is once more caused to rotationally oscillate. The drum oscillation causes the laundered items 106 to be ejected outwardly through the forward end openings of the drum and its enveloping shell along lower portions of their respective lips, the automatically ejected laundered items 106 simply falling into the cart 122 for convenient removal thereof.

It is at this stage of the overall laundry process that the uniquely sloped annular forward end portion 40 of the drum 30 (FIG. 5) comes into play. Specifically, although during the unloading process the machine body 12 is forwardly pivoted to only an approximately 7.5° angle, the forward slope of the annular drum portion 40 effectively adds another 15° of forward slope to the drum exit passage provided for the laundered items. Thus, the drum itself provides, in effect, an additional exit passage slope which need not be provided by further tilting the extremely heavy machine body section 12. Over a period of many unloading cycles, this unique built-in unloading slope within the drum itself provides significant energy cost savings over conventional machines which must be forwardly tilted through an angle of approximately 12° to effect unloading of the laundered items.

From the foregoing it can be seen that the present invention provides significantly improved washing machine apparatus in which the loading and unloading processes thereof are rendered significantly simpler, quicker, more efficient and significantly safer. The unique apparatus and structural modifications incorporated into the machine to provide these advantageous results are themselves relatively simple, reliable and inexpensive. Because of these improvements, the overall effectiveness and usefulness of the washing machine is significantly creased.

The foregoing detailed description is to be clearly understood as given by way of illustration and example only, the spirit and scope of the present invention being limited solely by the appended claims.

What is claimed is:

1. Washing machine apparatus comprising:

a washing drum adapted to receive launderable items and having an axis, a front end, rear end, and an interior side surface;

means for imparting to launderable items within said washing drum a washing action in which the items are caused to axially oscillate within said washing drum and to be repeatedly dropped from an upper interior side portion of said washing drum to a lower interior side portion thereof rearwardly displaced from said upper interior side portion, said means for imparting including:

drive means for causing rotational oscillation of said washing drum about said axis, means for positioning said axis at a downwardly and rearwardly inclined angle relative to horizontal during rotational oscillation of said washing drum about said axis;

rib means associated with said interior side surface of said washing drum for engaging the launderable items and causing axial oscillation thereof in response to rotational oscillation of said washing drum about said axis, said rib means comprising a circumferentially spaced series of essentially straight breaker ribs each projecting generally radially inwardly from said interior side surface of said washing drum and extending longitudinally of said washing drum at an angle relative to said axis, each of said breaker ribs having a radially inner side edge which tapers rearwardly and radially outwardly from a front end portion of the rib to a rear end portion thereof; and a body pivotable between a loading and washing position in which said body is essentially horizontal, and an unloading position in which said body is forwardly and downwardly inclined at a first angle relative to its horizontal loading and washing position, and pivot means for selectively pivoting said body between its loading and washing position and its unloading position, said washing drum being carried by said body at a second angle relative thereto in a manner such that when said body is in its horizontal loading and washing position said washing drum is rearwardly and downwardly inclined at said second angle relative to horizontal.

2. The washing machine apparatus of claim 1 wherein:

each of said breaker ribs extends longitudinally of said washing drum at an angle of approximately 15° relative to said axis.

3. The washing machine apparatus of claim 1 wherein:

each of said inner side edges of said breaker ribs is tapered at an angle of approximately 5° relative to said interior side surface of said washing drum.

4. The washing machine apparatus of claim 1 wherein:

said downwardly and rearwardly inclined angle of said axis is approximately 2.5°.

5. The washing machine apparatus of claim 1 wherein:

said front end of said washing drum has an opening therein through which launderable items may be loaded into an unloaded from said washing drum, said drive means are further operative to continuously rotate said washing drum in a selected single direction about said axis, and said rib means are further operative, during rotation of said washing drum in said selected single direction, to engage launderable items entering said opening during loading of said washing drum and to automatically draw the engages items rearwardly into said washing drum to facilitate loading thereof.

6. The washing machine apparatus of claim 1 further comprising:

chute means for further facilitating the loading of launderable items into said washing drum, said chute means including:

an inlet portion adapted to receive launderable items, and an outlet portion positionable in communication with the interior of said washing drum, while essentially entirely covering said front end opening of said drum, to discharge thereinto launderable items received in said inlet portion, and water supply means for flowing water from a source thereof through said cute means and into said washing drum to wet and diminish the overall volume of the launderable items and to assist in delivering the same into said washing drum.

7. The apparatus of claim 1 wherein:
said first angle is within the range of from about 7.5° to about 12°.
8. The apparatus of claim 7 wherein:
said first angle is approximately 7.5°.
9. The apparatus of claim 1 wherein:
said second angle is approximately 2.5°.
10. The apparatus of claim 1 wherein:
said apparatus further comprises a base frame,
said body is pivotally connected to said base frame, and
said pivot means include fluid operable actuating means operatively interconnected between said body and said base frame.
11. The apparatus of claim 1 wherein:
said apparatus further comprises chute means, having an outlet portion movable into communication with the interior of said washing drum, for receiving dry launderable items, and
water supply means for flowing water from a source thereof through said chute means to wet, compress and move launderable items through said chute means into said washing drum for engagement by said rib means.
12. Washing machine apparatus comprising:
a washing drum adapted to receive launderable items and having an axis, a front end, a rear end, and an interior side surface; and
means for imparting to launderable items within said washing drum a washing action in which the items are caused to axially oscillate within said washing drum and to be repeatedly dropped from an upper interior side portion of said washing drum to a lower interior side portion thereof rearwardly displaced from said upper interior side portion, said means for imparting including:
drive means for causing rotational oscillation of said washing drum about said axis,
means for positioning said axis at a downwardly and rearwardly inclined angle relative to horizontal during rotational oscillation of said washing drum about said axis, and
rib means associated with said interior side surface of said washing drum for engaging the launderable items and causing axial oscillation thereof in response to rotational oscillation of said washing drum about said axis,
said rib means comprising a circumferentially spaced series of essentially straight breaker ribs each projecting generally radially inwardly from said interior side surface of said washing drum and extending longitudinally of said washing drum at an angle relative to said axis, each of said breaker ribs having a radially inner side edge which tapers rearwardly and radially outwardly from a front end portion of the rib to a rear end portion thereof;
chute means, having an outlet portion movable into communication with the interior of said washing drum, for receiving dry launderable items;
water supply means for flowing water from a source thereof through said cute means to wet, compress and move launderable items through said chute means into said washing drum for engagement by said rib means; and
a body which carries said washing drum, said chute means being mounted on said body for movement between a first position in which said chute means are spaced apart from said front end opening of said washing drum, and a second position in which the outlet portion of said chute means is in communication with the interior of said washing drum and said chute means essentially entirely cover said front end opening.
13. The apparatus of claim 12 wherein:
said chute means have an open inlet portion, and
said water supply means include a water pipe header positioned adjacent said outlet portion and adapted to receive water from a source thereof, and series of water outlet openings formed therein for delivering water to the interior of said chute means.
14. Washing machined apparatus comprising:
a washing drum circumscribing an axis and having a front end opening through which launderable items may be loaded into and unloaded from said washing drum, a rear end wall, and an interior side wall surface, said washing drum having a washing position in which said axis is downwardly and rearwardly inclined at a predetermined angle relative to horizontal;
drive means selectively operable to continuously rotate said washing drum in a selected single direction about said axis or to rotationally oscillate said washing drum in opposite directions about said axis; and
rib means associated with said interior side wall surface of said washing drum, said rib means comprising a circumferentially spaced series of essentially straight breaker ribs each projecting radially inwardly from said interior side wall surface and extending longitudinally of said washing drum at an angle relative to said axis, each of said breaker ribs having a radially inner side edge which tapers rearwardly and radially outwardly from a front end portion of the rib to a rear end portion thereof, said rib means being operative to:
engage launderable items entering said front end opening and automatically draw the engaged items rearwardly into the interior of said washing drum, in response to continuous rotation thereof in said selected single direction about said axis, to facilitate loading of said washing drum, and
cause axial oscillation of launderable items disposed within said washing drum, during rotational oscillation thereof about said axis when said washing drum is in its washing position, to facilitate cleaning of such items,
the downward and rearward inclination of said washing drum in its washing position further facilitating the cleaning of such items by causing items dropped from an upper interior portion of said washing drum to land upon a lower interior portion thereof rearwardly displaced from said upper interior portion, thereby augmenting the axial movement of the items caused by said rib means during rotational oscillation of said washing drum about said axis;
a body internally carrying said washing drum;
chute means, communicable with the interior of said washing drum, for receiving launderable items;
water supply means for selectively flowing water from a source thereof through said chute means and into said washing drum to west and compress launderable items disposed in said chute means, and to assist in carrying the wetted and compressed items through said chute means into said washing drum during loading of said washing drum;

mounting means for pivotally mounting said chute means on an upper front end portion of said body for movement relative thereto between a first position in which said chute means are spaced apart from said front end opening of said washing drum, and a second position in which said chute means are in operative communication with the interior of said washing drum, and said chute means essentially cover said front end opening; and actuating means for selectively pivoting said chute means between said first and second positions thereof.

15. The apparatus of claim 14 wherein:

said apparatus further comprises counterweight means, connected to said mounting means, for counterbalancing the weight of said chute means.

16. The apparatus of claim 14 wherein:

said chute means include a loading chute having an open inlet end and an open outlet end, said mounting means include an elongated pivot member rotatably connected at opposite end portions thereof to an upper end portion of said body, a pair of support arms interconnected between said loading chute and said pivot member, and an extension member secured to said pivot member, and said actuating means include a fluid-operable actuating cylinder operatively interconnected between said body and said extension member.

17. The apparatus of claim 16 wherein:

said apparatus further comprises counterweight means, connected to said pivot member, for exerting a torque on said pivot member to counterbalance the torque imposed thereon by said loading chute.

18. The apparatus of claim 17 wherein:

said counterweight means include at least one weight support member secured to said pivot member and adapted to hold a series of counterweight members.

19. The apparatus of claim 14 wherein:

said washing drum is outwardly circumscribed by a shell member having an annular forward end lip, and said chute means have a circular outlet opening outwardly circumscribed by an annular gasket adapted to engage and be compressed by said forward end lip of said shell member.

20. The apparatus of claim 14 wherein:

said washing drum has an annular forward end wall portion which circumscribes said front end opening and is inwardly and forwardly sloped at a slope angle relative to a plane perpendicularly intersected by said axis and positioned rearwardly of said forward end wall portion.

21. The washing machine apparatus of claim 20 wherein:

said first angle is within the range of from about 7.5° to about 12°.

22. The washing machine apparatus of claim 20 wherein:

said second angle is approximately 2.5°.

23. Washing machined apparatus comprising:

a washing drum circumscribing an axis and having a front end opening through which launderable items may be loaded into and unloaded from said washing drum, a rear end wall, and an interior said wall surface, said washing drum having a washing position in which said axis is downwardly and rearwardly inclined at a predetermined angle relative to horizontal;

a body internally carrying said washing drum, said body being pivotable between a loading and washing position in which said body is essentially horizontal, and an unloading position in which said body is forwardly and downwardly inclined at a first angle relative to its horizontal loading and washing position, said washing drum being carried by said body at a second angle relative thereto in a manner such that when said body is in its horizontal loading and washing position said washing drum is rearwardly and downwardly inclined at said predetermined angle relative to horizontal;

pivot means for selectively pivoting said body between its loading and washing position and its unloading position;

drive means selectively operable to continuously rotate said washing drum in a selected single direction about said axis or to rotationally oscillate said washing drum in opposite directions about said axis; and rib means associated with said interior side wall surface of said washing drum, said rib means comprising a circumferentially spaced series of essentially straight breaker ribs each projecting radially inwardly from said interior side wall surface and extending longitudinally of said washing drum at an angle relative to said axis, each of said breaker ribs having a radially inner side edge which tapers rearwardly and radially outwardly from a front end portion of the rib to a rear end portion thereof, said rib means being operative to:

engage launderable items entering said front end opening and automatically draw the engaged items rearwardly into the interior of said washing drum, in response to continuous rotation thereof in said selected single direction about said axis, to facilitate loading of said washing drum, and cause axial oscillation of launderable items disposed within said washing drum, during rotational oscillation thereof about said axis when said washing drum is in its washing position, to facilitate cleaning of such items, the downward and rearward inclination of said washing drum in its washing position further facilitating the cleaning of such items by causing items dropped from an upper interior portion of said washing drum to laud upon a lower interior portion thereof rearwardly displaced from said upper interior portion, thereby augmenting the axial movement of the items caused by said rib means during rotational oscillation of said washing drum about said axis.

24. The apparatus of claim 23 wherein:

said first angle is within the range of from about 7.5° to about 12°.

25. The apparatus of claim 24 wherein:

said first angle is approximately 7.5°.

26. The apparatus of claim 23 wherein:

said second angle is approximately 2.5°.

27. The apparatus of claim 23 wherein:

said apparatus further comprises a base frame, said body is pivotally connected to and is supported on said base frame, and said pivot means include fluid operable actuating means operatively interconnected between said base frame and said body.

28. The apparatus of claim 27 wherein:

said actuating means include at least one pneumatic actuating cylinder.

29. The apparatus of claim 27 wherein:

said slope angle is approximately 15°.

30. The washing machine apparatus of claim 29 wherein:

said first angle is approximately 7.5°.

31. Washing machine apparatus comprising:

a base;

a hollow body having front and rear ends spaced apart along a body axis, said hollow body being carried by said base for pivotal movement relative thereto about a horizontal axis transverse to said body axis between a washing and loading position in which said body axis is essentially horizontal, and an unloading position in which said body axis is forwardly and downwardly inclined at a first angle relative to horizontal;

means for selectively pivoting said hollow body relative to said base between said washing and loading position and said unloading position;

a washing drum carried within said hollow body for rotation relative thereto about a drum axis tilted relative to said hollow body axis in a manner such that when said hollow body is in its essentially horizontal washing and loading position said washing drum axis is rearwardly and downwardly inclined at a second angle relative to horizontal, said washing drum having a front end positioned adjacent said front end of said hollow body, and a rear end spaced rearwardly from said front end of said washing drum along said drum axis, said front end of said washing drum having an opening therein through which launderable items may be loaded into and unloaded from said washing drum;

means for selectively rotating said washing drum about said drum axis relative to said hollow body;

rib means, carried within said washing drum and responsive to rotation thereof about said drum axis when said hollow body is in its essentially horizontal washing and loading position, for engaging launderable items entering said opening in said front end of said washing drum and automatically drawing the engaged launderable items rearwardly into the interior of said washing drum to facilitate loading thereof;

chute means for receiving launderable items and transferring the received launderable items into the interior of said washing drum through said front end opening therein for operative engagement by said rib means, said chute means being mounted on an upper front end portion of said body for pivotal motion relative thereto about a horizontal axis transverse to said body axis between a raised position in which said chute means are spaced apart from said front end opening in said washing drum, and a lowered loading position in which said chute means cover said front end opening and essentially prevent hand entry thereinto;

means for selectively pivoting said chute means between said raised and lowered positions thereof; and water supply means for selectively flowing water from a source thereof through said chute means in said lowered position thereof into said washing drum, when said hollow body is in its essentially horizontal washing and loading position, to wet and compress dry launderable items disposed in said chute means, and to assist in carrying the wetted and compressed items through said chute means into said washing drum, for engagement by said rib means, during loading of said washing drum.

32. Washing machined apparatus comprising:

a washing drum adapted to receive launderable items and having an axis, a front end, a rear end, and an interior side surface;

means for imparting to launderable items within said washing drum a washing action in which the items are caused to axially oscillate within said washing drum and to be repeatedly dropped from an upper interior side portion of said washing drum to a lower interior side portion thereof rearwardly displaced from said upper interior side portion, said means for imparting including:

drive means for causing rotational oscillation of said washing drum about said axis, means for positioning said axis at a downwardly and rearwardly inclined angle relative to horizontal during rotational oscillation of said washing drum about said axis, and rib means associated with said interior side surface of said washing drum for engaging the launderable items and causing axial oscillation thereof in response to rotational oscillation of said washing drum about said axis;

a body pivotable between a loading an washing position in which said body is essentially horizontal, and an unloading position in which said body is forwardly and downwardly inclined at a first angle relative to its horizontal loading and washing position, said washing drum being carried by said body at a second angle relative thereto in a manner such that when said body is in its horizontal loading and washing position said washing drum is rearwardly and downwardly inclined at said second angle relative to horizontal; and pivot means for selectively pivoting said body between its loading and washing position and its unloading position.

33. Washing machine apparatus comprising:

a washing drum adapted to receive launderable items and having an axis, a front end, a rear end, and an interior side surface; and means for imparting to launderable items within said washing drum a washing action in which the items are caused to axially oscillate within said washing drum and to repeatedly dropped from an upper interior side portion of said washing drum to a lower interior side portion thereof rearwardly displaced from said upper interior side portion, said means for imparting including:

drive means for causing rotational oscillation of said washing drum about said axis, means for positioning said axis at a downwardly and rearwardly inclined angle relative to horizontal during rotational oscillation of said washing drum about said axis, and rib means associated with said interior side surface of said washing drum for engaging the launderable items and causing axial oscillation thereof in response to rotational oscillation of said washing drum about said axis;

a body carrying said washing drum;

chute means, having an outlet portion movable into communication with the interior of said washing drum, for receiving launderable items, said chute means being mounted on said body for movement between a first position in which said chute means are spaced apart from said front end opening of said washing drum, and a second position in which the outlet portion of said chute means is in communication with the interior of said washing drum and said chute means essentially entirely cover said front end opening; and water supply means for flowing water from a source thereof through said chute means to wet, compress and move launderable items through said chute means into said washing drum for engagement by said rib means.

34. Washing machine apparatus comprising:

a washing drum circumscribing an axis and having a front end opening through which launderable items may be loaded into and unloaded from said washing drum, a rear end wall, and an interior side wall surface, said washing drum having a washing position in which said axis is downwardly and rearwardly inclined at a predetermined angle relative to horizontal;

drive means selectively operable to continuously rotate said washing drum in a selected single direction about said axis or to rotationally oscillate said washing drum in opposite directions about said axis; and rib means associated with said interior said wall surface of said washing drum, said rib means being operative to:

engage launderable items entering said front end opening and automatically draw the engaged items rearwardly onto the interior of said washing drum, in response to continuous rotation thereof in said selected single direction about said axis, to facilitate loading of said washing drum, and cause axial oscillation of launderable items disposed within said washing drum, during rotational oscillation thereof about said axis when said washing drum is in its washing position, to facilitate cleaning of such items, the downward and rearward inclination of said washing drum in its washing position further facilitating the cleaning of such items by causing items dropped from an upper interior portion of said washing drum to land upon a lower interior portion thereof rearwardly displaced from said upper interior portion, thereby augmenting the axial movement of the items caused by said rib means during rotational oscillation of said washing drum about said axis;

a body internally carrying said washing drum, chute means, communicable with interior of said washing drum, for receiving launderable items, water supply means for selectively flowing water from a source thereof through said cute means and into said washing drum to wet and compress launderable items disposed in said chute means, and to assist in carrying the wetted and compressed items through said chute means into said washing drum during loading of said washing drum, mounting means for pivotally mounting said chute means on an upper front end portion of said body for movement relative thereto between a first position in which said chute means are spaced apart from said front end opening of said washing drum, and a second position in which said chute means are in operative communication with the interior of said washing drum, and said chute means essentially entirely cover said front end opening; and actuating means for selectively pivoting said chute means between said first and second positions thereof.

* * * * *

UNITED STATES PATENT AND TRADEMARK OFFICE

CERTIFICATE OF CORRECTION

PATENT NO. : 4,835,993

DATED : June 6, 1989

INVENTOR(S) : Adolph E. S. Dreher

It is certified that error appears in the above-identified patent and that said Letters Patent is hereby corrected as shown below:

Column 4, line 56, delete "i" and insert --is--.

Column 5, line 5, delete "f" and insert --of--.

Column 8, line 38, delete "parts" and insert --its--.

Column 12, line 49, delete "engages" and insert --engaged--.

Column 14, line 11, after "and" insert --a--.

Column 14, line 14, delete "machined" and insert --machine--.

Column 15, line 11, after "essentially" insert --entirely--.

Column 15, line 63, delete "machined" and insert --machine--.

Column 15, line 67, delete "said" and insert --side--.

Column 18, line 55, after "to" insert --be--.

Column 19, line 39, delete "onto" and insert --into--.

Signed and Sealed this

Thirteenth Day of March, 1990

*Attest:*

JEFFREY M. SAMUELS

*Attesting Officer*

*Acting Commissioner of Patents and Trademarks*